US005079059A

United States Patent [19]

Wyslotsky

[11] Patent Number: 5,079,059

[45] Date of Patent: Jan. 7, 1992

[54] STRIPPABLE SEAL MECHANISM

[75] Inventor: Ihor Wyslotsky, Rolling Meadows, Ill.

[73] Assignee: Redex Packaging Corp., Rolling Meadows, Ill.

[21] Appl. No.: 555,308

[22] Filed: Jul. 20, 1990

Related U.S. Application Data

[63] Continuation-in-part of Ser. No. 543,033, Jun. 25, 1990.

[51] Int. Cl.[5] ..... B65D 65/28; B65D 65/32

[52] U.S. Cl. ..... 428/43; 428/41; 428/163; 428/172; 428/212; 383/207; 383/211

[58] Field of Search ..... 428/43, 41, 163, 172; 206/484, 631, 632, 610, 613; 220/270, 276, 269

[56] References Cited

U.S. PATENT DOCUMENTS

| | | | |
|---|---|---|---|
| 3,655,503 | 4/1972 | Stanley | 206/632 |
| 4,513,876 | 4/1985 | Buchner | 220/270 |
| 4,521,467 | 6/1985 | Berger | 428/43 |
| 4,638,913 | 1/1987 | Howe, Jr. | 206/484 |
| 4,712,706 | 12/1987 | Nakata | 220/270 |
| 4,875,587 | 10/1989 | Lulham | 206/484 |
| 4,913,307 | 4/1990 | Takata | 220/276 |
| 4,944,409 | 7/1990 | Busche | 206/484 |

*Primary Examiner*—Ellis P. Robinson
*Assistant Examiner*—Nasser Ahmad
*Attorney, Agent, or Firm*—Allegretti & Witcoff, Ltd.

[57] ABSTRACT

The improved strippable seal mechanism inclues first and second polymeric webs each having an exterior and interior surface. The interior surface of at least one of the first and second polymeric webs polymeric webs has a substantially adhesive surface thereon for fixedly but separably adhering to the other polymeric web's interior surface. One of the first and second polymeric webs has at least one line of reduced strength disposed at the exterior surface thereof. A manually grippable tab is disposed adjacent to and operatively connected to the line of reduced strength at the exterior surface of one of the polymeric webs. The manually grippable tab operates in conjunction with the line of reduced strength to direct a peel force along the line of reduced strength to delaminate one of the first and seocnd polymeric webs.

19 Claims, 1 Drawing Sheet

STRIPPABLE SEAL MECHANISM

BACKGROUND OF THE INVENTION

This is a continuation-in-part of the co-pending patent application of like inventor, Ihor Wyslotsky, entitled "Improved Multiple Component Pressurized Package For Articles And Methods Of Pressurization Thereof", Ser. No. 543,033, filed on Jun. 25, 1990.

The present invention relates in general to packaging elements, and more particularly to an improved strippable seal mechanism, such as may be useable in connection with packaging for a wide variety of goods and products, including industrial products, medical products, small items, comestible products, including prepared meats, inter alia.

In the prior art, there has been a wide proliferation of packages made from various polymeric materials including many different sizes, shapes, textures and properties. With polymeric packaging, as with other packaging, reliable and easily operable access mechanisms are required in order to make the contents of the package readily and easily available to the user. Of course, access mechanisms for such packages have varied depending on the type of package (e.g., barrier, pressurized, evacuated, etc.), the type of contents, the intended use of the contents, the reusability and/or recloseability required for the package (e.g., depending upon whether all the contents are used at one time, etc.)—as well as a host of other factors.

In some prior art applications utilizing polymeric packaging, the access mechanism provided to such packaging has added unnecessary costs to the price of the packaging. In other instances, the access mechanism provided to the user has proved to have been less than technically adequate, and upon utilization has resulted in damage to the contents or to the package structure, such as for example, in making the packaging nonrecloseable. Yet other access mechanisms such packaging have resulted in non-structural damage to the aesthetics of the packaging and/or to the visual indicia contained upon the package, such as indicating its source of origin, instructions to the user, advertising or promotional material, etc.

In view of the above defects, difficulties and/or deficiencies of prior art packaging and access mechanisms for such packaging, it is a material object of the improved strippable seal mechanism of the present invention to alleviate materially those defects, difficulties and/or deficiencies.

These and other objects of the improved strippable seal mechanism of the present invention will become more apparent upon the review of the following disclosure of the present invention.

SUMMARY OF THE INVENTION

The improved strippable seal mechanism of the present invention, in certain broad embodiments, includes first and second polymeric webs, each having an exterior and interior surface. The interior surface of at least one of the first and second polymeric webs has a substantially adhesive surface thereon for fixedly, but separably adhering to the interior surface of the other polymeric web. Additionally, one of the first and second polymeric webs has at least one line of reduced strength disposed at the exterior surface thereof.

A manually grippable tab is disposed adjacent to and operatively connected to the line of reduced strength at the exterior surface of one of the polymeric webs. The line of reduced strength may comprise a groove cut into the exterior surface of the polymeric web. The manually grippable tab operates in conjunction with the line of reduced strength by means of directing a peel force along the line of reduced strength to delaminate the first and second polymeric webs. In various alternative embodiments, the first and second polymeric webs may either or each comprise laminates, and the delamination which occurs (incident to the use of the manually grippable tab and its accompanying peeling force) may serve to delaminate a polymeric web per se, rather than separating one polymeric web from the other.

The improved strippable seal mechanism of the present invention may be better understood in conjunction with the following brief description of the drawing, detailed description of preferred embodiments, appended claims and accompanying drawing.

BRIEF DESCRIPTION OF THE DRAWING

The improved strippable seal mechanism of the present invention is set forth in the accompanying drawing, and in which.

DETAILED DESCRIPTION OF PREFERRED EMBODIMENTS

Figure 1:
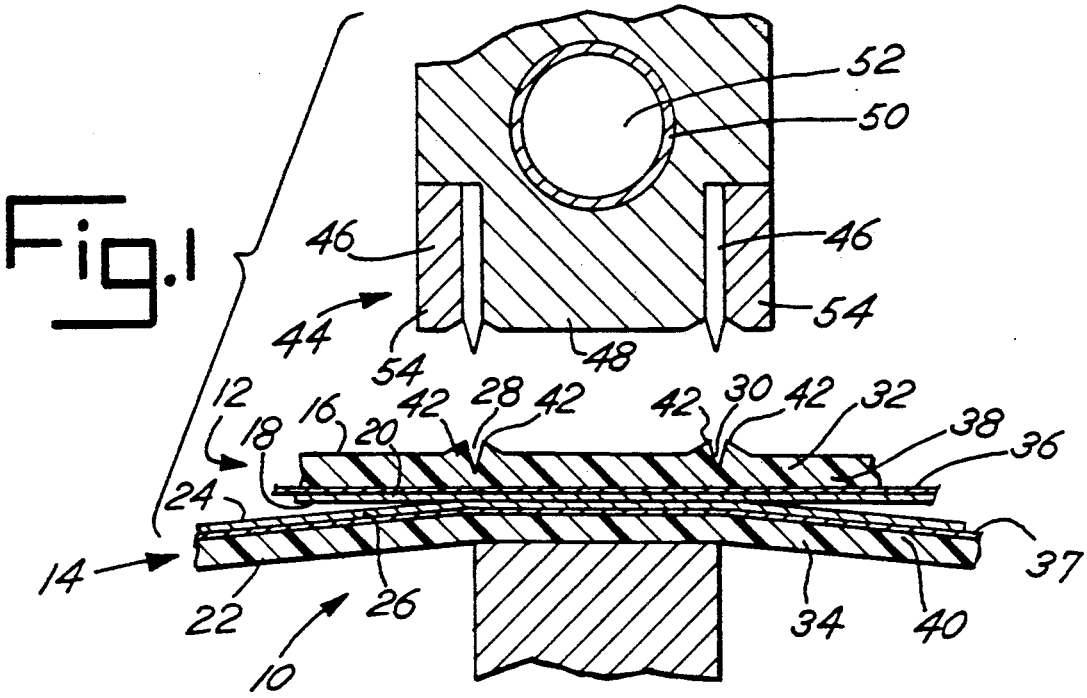
FIG. 1 is an enlarged transverse cross-sectional view of an upper heated seal bar containing an indentation mechanism and a lower seal bar, which may be heated, with first and second polymeric webs disposed therebetween, each of which is a laminate of several layers, and illustrating the operation by which lines of reduced strength are disposed into the polymeric web.

The improved strippable seal mechanism of the present invention includes first and second polymeric webs. The first polymeric web has a first polymeric web exterior and interior surface, with the interior surface thereof having a substantially adhesive surface thereon for fixedly adhering to another surface. In certain embodiments, the adhesive surface disposed on the interior surface of one of the first and second polymeric webs may separably adhere to another surface.

Such corresponding second polymeric web is disposed in facing laminated contact with the first polymeric web and has second polymeric web exterior and interior surfaces, with the interior surface having a substantially adhesive surface thereon for fixedly adhering the first polymeric web interior surface to the second polymeric web interior surface.

One of the first polymeric web and second polymeric web has at least one line of reduced strength disposed at the exterior surface thereof. A manually grippable tab is disposed adjacent to and in operative connection with a line reduced strength of the exterior surface of one of the polymeric webs. The manually grippable tab is utilized to direct a peel force to one of the first and second polymeric webs for delamination along the line(s) of reduced strength. In certain preferred embodiments, two lines of reduced strength are disposed in spaced array in the polymeric web to permit a strip to be pulled from a portion of the polymeric web which is disposed between the two lines of reduced strength.

In some preferred embodiments, at least one of the first and second polymeric webs is a laminate. Such laminate may comprise a primary plastic layer and a barrier layer. Such barrier layer is preferably disposed interiorly of the primary plastic layer. A sealant layer may also, in other embodiments, be disposed interiorly of the barrier layer. Such sealant layer may preferably comprise the adhesive surface. In other preferred embodiments, a tie layer may be disposed between the primary plastic layer and the barrier layer. Each of the first polymeric web and the second polymeric web may include a tie layer. One of the polymeric web tie layers has a lower peel strength than the other such tie layer. The first and second polymeric web tie layers may comprise a film blend of ethyl-vinyl acetate and linear low density polyethylene. One of the polymeric web tie layers may comprise a blend of approximately 26% ethyl-vinyl acetate in low linear density polyethylene. The other of the polymeric web tie layers may preferably comprise a blend of approximately 18% ethyl-vinyl acetate in low linear density polyethylene. Thus, one of such tie layers may have a peel strength of approximately 1800 grams per inch of width thereof, based upon its 26% blend. The other tie layer (and in certain embodiments, the lower tie layer of the lower polymeric web) may have a peel strength of approximately 1000–1200 grams per inch of width thereof for an 18% blend. In such preferred embodiments, the tie layer of greater peel strength is disposed on the polymeric web having the manually grippable tab thereon, which structure assures delamination of the other, oppositely disposed polymeric web at the tie layer thereof, which is of lower peel strength.

At least one of the lines of reduced strength may comprise a groove which is disposed to a substantial depth into the exterior surface of one of the first polymeric web and second polymeric web. Such line of reduced strength may comprise a groove which is disposed to a substantial depth in the exterior surface of a primary plastic layer. The groove, in preferred embodiments, is substantially V-shaped in transverse cross-section. A first raised shoulder portion may be disposed immediately laterally of the groove for supplementally directing the stripping of the polymeric web along the groove in the exterior surface of one of the polymeric webs. A second raised shoulder may be disposed medially of the groove for further supplementally directing the stripping of the polymeric web along the groove of the exterior surface of one of the polymeric webs.

The exterior surface of one of the first polymeric web and second polymer web preferably comprises a thermoplastic polymeric material which is capable of receiving a heated knife thereunto for melting a groove therewithin to form the line of reduced strength.

Figure 2:
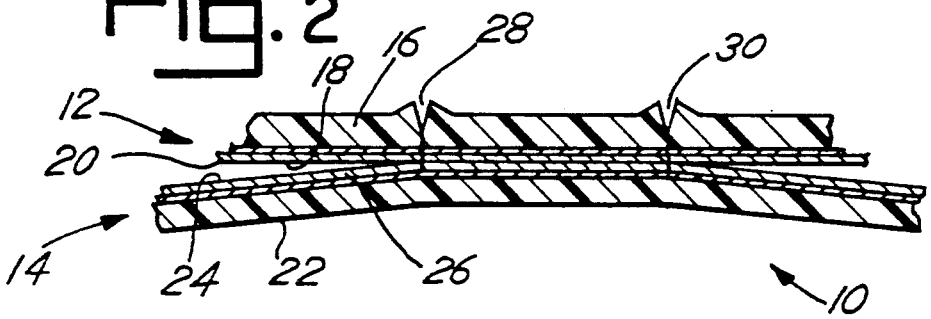
FIG. 2 is an enlarged transverse cross-sectional view of such first and second polymeric webs as shown in FIG. 1, and showing the operation of the peel force directed along the lines of reduced weakness there comprising grooves and further showing delamination of one of the polymeric web laminates.

Referring now to the drawing, the improved strippable seal mechanism generally 10 of the present invention includes first and second polymeric webs generally 12, 14, as shown in FIGS. 1 and 2. First polymeric web 12 has a first polymeric web exterior surface 16 and interior surface 18, with interior surface 18 thereof having a substantial adhesive means thereon for fixedly adhering to another surface. In certain embodiments, the adhesive means disposed on interior surface 18 of first polymeric web 12 may comprise a sealant layer 20, and may separably adhere to another surface.

Such corresponding second polymeric web 14 is disposed in facing laminated contact with first polymeric web 12 and has second polymeric web exterior and interior surfaces 22, 24 with interior surface 24 having substantially adhesive means thereon for fixedly adhering first polymeric web interior surface 18 to second polymeric web interior surface 24. Such adhesive means may comprise a sealant layer 26 for such second polymeric web 14.

As shown in FIGS. 1 and 2, first polymeric web 12 has a pair of lines of reduced strength in the form of grooves 28, 30 disposed at the interior surface 18 thereof. A manually grippable tab is disposed adjacent to and in operative connection with grooves 28, 30, and is utilized to direct a peel force to one of the first and second polymeric webs 12, 14 for delamination along the lines of reduced strength.

Figure 3:
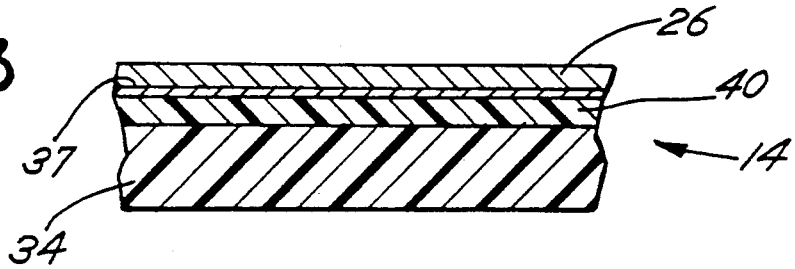
FIG. 3 is a greatly enlarged cross-sectional view of one of the first and second polymeric webs showing its laminated structure, and including in such embodiment a sealant layer, a barrier layer, a tie layer, and a primary plastic layer.

As shown in FIGS. 1, 2 and 3, first and second polymeric webs 12, 14 are laminates. Such laminates respectively have primary plastic layers 32, 34 and barrier layers 36, 37. Such barrier layer 36 is shown as disposed interiorly of primary plastic layer 32. Sealant layers 20, 26 are disposed interiorly of respective barrier layers 36, 38. In other preferred embodiments, respective tie layers 38, 40 are disposed respectively between primary plastic layers 32, 34 and barrier layers 36, 37. One of the polymeric web tie layers 40 has a lower peel strength than the other such tie layer 38. First and second polymeric web tie layers 38, 40 may comprise a film blend of ethyl-vinyl acetate and linear low density polyethylene. Polymeric web tie layer 38 may comprise a blend of approximately 26% of the ethyl-vinyl acetate in low linear density polyethylene. The other of the polymeric web tie layers 40 may preferably comprise a blend of approximately 18% ethyl-vinyl acetate in low linear density polyethylene. Thus, first polymeric web tie layer 38 may have a peel strength of approximately 1800 grams per inch of width thereof, based upon its 26% blend. Second polymeric web tie layer 40 may have, for example, a peel strength of approximately 1000–1200 grams per inch of width thereof. In such preferred embodiments, the tie layer 38 of greater peel strength is disposed on the polymeric web having the manually grippable tab thereon, which structure assures delamination of the other oppositely disposed polymeric web at the tie layer 40 thereof, which is of lower peel strength.

As shown in FIGS. 1 and 2, the lines of reduced strength comprises grooves 28, 30 which are disposed to a substantial depth into the exterior surface 16 of first polymeric web 12. The grooves 28, 30 are substantially V-shaped in transverse cross-section. Raised shoulder portions 42 may be disposed immediately laterally and medially of grooves 28, 30 for supplementally directing the stripping of the polymeric web along grooves 28, 30 in exterior surface 16 of polymeric web 12.

Exterior surface 16 of first polymeric web 12 preferably comprises a thermoplastic polymeric material which is capable of receiving a heated knife generally 44 thereunto for melting grooves 28, 30 therewithin. As shown in FIG. 1, heated knife 44 includes a pair of heated knife blades 46, 46 disposed in spaced array and separated by a heat source bar 48, which is supplied by a heat source 50. Heat source 50 may comprise a conduit for circulating a heated liquid 52 therewithin. Such heated knife 44 may also include a pair of cold heels 54, 54 disposed exteriorly of knife blades 46, 46.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. An improved strippable seal mechanism comprising:

a first polymer web having first polymeric web exterior and interior surfaces, said interior surface having substantially adhesive means thereon for fixedly adhering to another surface;

a second polymer web disposed in facing laminated contact with said first polymeric web and having second polymeric web exterior and interior surfaces, said interior surface having substantially adhesive means thereon for fixedly adhering said first polymeric web interior surface to said second polymeric web interior surface;

said first polymeric web having at least one line of reduced strength disposed at the exterior surface thereof; and manually grippable tab means connected to said first polymeric web and disposed adjacent to and in operative connection with said line of reduced strength at said exterior surface of said first polymeric web for directing a peeling force for delamination along said line of reduced strength;

an integrally removable peel portion on formed by said delamination along said line of reduced strength, said peel portion attached to said manually grippable tab means;

each of said first and second polymeric webs having a primary plastic layer and a barrier layer with respective first and second tie layers disposed respectively therebetween;

said tie layer which is disposed on said first polymeric web having a greater peel strength than said tie layer disposed within said second polymeric web, whereby upon exerting a peel force upon said manually grippable tab, the entire thickness of said first polymeric web and a portion of the thickness of said second polymeric web may be together peeled off clearly along said line of reduced strength to form a substantially smooth peel edge along said line of reduced strength; and said integrally removable peel portion having a thickness greater than said first polymeric web to assure strength and continuing integrity of said integrally removable peel portion during peeling.

2. The improved strippable seal mechanism of claim 1 wherein said barrier layer is disposed interiorly of said primary plastic layer.

3. The improved strippable seal mechanism of claim 1 further comprising a sealant layer disposed interiorly of said barrier layer.

4. The improved strippable seal mechanism of claim 3 wherein said sealant layer comprises said adhesive means.

5. The improved strippable seal mechanism of claim 1 wherein each of said first and second polymeric web tie layers comprises a film of ethyl vinyl acetate and linear low density polyethylene.

6. The improved strippable seal mechanism of claim 5 wherein one of said polymer web tie layers comprises a blend of approximately 26% of said ethyl vinyl acetate in linear low density polyethylene.

7. The improved strippable seal mechanism of claim 6 wherein the other of said polymer web tie layers comprise a blend of approximately 18% ethyl vinyl acetate in low linear density polyethylene.

8. The improved strippable seal mechanism of claim 1 wherein one of said tie layers has a peel strength of approximately 1800 grams per inch of width thereof.

9. The improved strippable seal mechanism of claim 8 wherein the other of said tie layers has a peel strength of approximately 1000–1200 grams per inch of width thereof.

10. The improved strippable seal mechanism of claim 1 wherein said at least one line of reduced strength comprises a groove disposed to a substantial depth into the exterior surface of one of said first polymeric web and said second polymeric web.

11. The improved strippable seal mechanism of claim 1 wherein said at least one line of reduced strength comprises a groove disposed to a substantial depth into the exterior surface of said primary plastic layer.

12. The improved strippable seal mechanism of claim 10 wherein said groove is substantially V-shaped in transverse cross-sectional shape.

13. The improved strippable seal mechanism of claim 10 further comprising first raised shoulder portion means disposed immediately lateral of said groove for supplementally directing the stripping of the polymeric web along said groove in said exterior surface of one of said polymeric webs.

14. The improved strippable seal mechanism of claim 13 further comprising means disposed medially of said groove for further supplementally directing the stripping of the polymeric web along said groove in said exterior surface of one of said polymeric webs.

15. The improved strippable seal mechanism of claim 1 wherein said exterior surface of one of said first polymeric web and said second polymeric web comprises a thermoplastic polymeric material capable of receiving heated knife means thereunto for melting a groove therewithin a form said line of reduced strength.

16. The improved strippable seal mechanism of claim 1 wherein at least one of said first polymeric web is a laminate of at least two layers of polymeric films.

17. The improved strippable seal mechanism of claim 16 wherein said laminate is delaminated along said line of reduced strength by said peel force.

18. The improved strippable seal mechanism of claim 1 wherein said adhesive means disposed on said interior surface of one of said first and second polymeric webs fixedly but separably adheres to another surface.

19. The improved strippable seal mechanism of claim 1 wherein said polymeric web has two lines of reduced strength disposed in spaced array to permit a strip to be pulled from the portion of the polymeric web disposed therebetween.

* * * * *